US006400250B1

(12) United States Patent
Wang

(10) Patent No.: US 6,400,250 B1
(45) Date of Patent: Jun. 4, 2002

(54) SAFETY SWITCH

(75) Inventor: Ming-Shan Wang, Taipei (TW)

(73) Assignee: Tsung-Mou Yu, Taipei Hsien (TW)

( * ) Notice: Subject to any disclaimer, the term of this patent is extended or adjusted under 35 U.S.C. 154(b) by 97 days.

(21) Appl. No.: 09/616,680

(22) Filed: Jul. 14, 2000

(51) Int. Cl.[7] ..... H01H 71/16; H01H 71/58
(52) U.S. Cl. ..... 337/66; 337/68; 337/72
(58) Field of Search ..... 337/1, 3, 12–14, 337/16, 36, 37, 53, 59, 62, 66, 68, 72, 75, 85, 89, 101, 111, 112, 113, 140

(56) References Cited

U.S. PATENT DOCUMENTS

| | | | | | |
|---|---|---|---|---|---|
| 4,337,450 | A | * | 6/1982 | Matthies | 337/102 |
| 5,262,748 | A | * | 11/1993 | Tsung-Mou | 337/66 |
| 5,498,846 | A | * | 3/1996 | Chin | 200/553 |
| 5,539,371 | A | * | 7/1996 | Yu | 337/66 |
| 5,694,106 | A | * | 12/1997 | Wang | 337/53 |
| 5,760,672 | A | * | 6/1998 | Wang | 337/66 |
| 5,828,284 | A | * | 10/1998 | Huang | 337/112 |
| 5,847,638 | A | * | 12/1998 | Sorenson | 200/553 |
| 5,892,426 | A | * | 4/1999 | Huang | 337/334 |
| 6,072,381 | A | * | 6/2000 | Yu | 337/112 |

FOREIGN PATENT DOCUMENTS

| | | | | |
|---|---|---|---|---|
| CH | 647094 A | * | 12/1984 | H01H/71/16 |
| JP | 2001-6514 A | * | 1/2001 | H01H/73/22 |

* cited by examiner

*Primary Examiner*—Anatoly Vortman
(74) *Attorney, Agent, or Firm*—Rosenberg, Klein & Lee

(57) ABSTRACT

The present invention relates to a safety switch for protecting circuit having a change-over push-pull rod between a button shade and a conductive strip. The top end of the push-pull rod is pivotally connected to the button shade while the bottom end thereof includes a pushing part and a pulling part which are not the same length. The push-pull rod and the external end of the conductive strip are not coupled, but situated in a pushing and pulling change-over relationship. In cooperation with the inner and outer spring elements and a play groove, the conductive strip will be collapsed in a manner of reverse deformation for a disconnection when the current is overloaded, without restricted by the pushing part and the pulling part. Besides, the safety switch includes the ON-OFF change-over function under ordinary state. The configuration is therefore simplified and the user safety is much more ensured.

2 Claims, 13 Drawing Sheets

SAFETY SWITCH

BACKGROUND OF THE INVENTION

1. Field of the Invention

The present invention relates to an improved safety switch for protecting circuit, and more particularly to a safety switch having a push-pull rod (coupled element) between a button shade (change-over button) and a conductive piece. The push-pull rod is formed in a collapsing manner. When the switch is overloaded, the conductive piece can be completely disconnected in order to ensure the electrical safety.

2. Description of the Prior Art

A conventional wall-mounted see-saw switch, as shown in FIG. 1, is usually used to control the On/Off of a light and which generally includes a button 11 capable of being positioned in two different positions as an exerted force is applied at one end for establishing a closed or opened circuit via a retaining tab 110 which butts against a plate 12. However, this see-saw switch must be operated manually such that the closed or opened circuit can be attained once the button is pressed at one end. Unless the button is pressed at one end, otherwise the see-saw switch will remain in a preset position, i.e. opened circuit is remained in opened position; and closed circuit is remained in closed position. This see-saw switch can not be switched from the closed position to an opened position even if an overload is encountered. If the supplied power can not be interrupted immediately, the electric conductive wires will become more and more hot, eventually, a risk of getting a fire can be encountered. In light of this, the safety and property of user can not be suitably protected.

U.S. Pat. No. 5,262,748, entitled to "Fuseless Breaking Switch", hereinafter referred to as '748, has disclosed a subject matter which is intended to solve the defects of the conventional see-saw switch. This fuseless breaking switch comprises a casing 10 having a button 13 pivotally mounted thereof. The bottom of the casing 10 is further provided with three sets of prongs 15, 16, 17. One set of the prongs 17 is disposed with a contact reed 170 having a platinum conductive protrusion 171 thereof. One end of the contact reed 170 is disposed above the corresponding prong 16 and is electrically connectable with the platinum conductive protrusion 160. The button 13 is further provided with a coupled piece 14, the other end of which is in turn connected to contact reed 170. When the button 13 is depressed, the prongs 16, 17 is electrically connected via the contact reed 170 and the platinum conductive protrusion 171, 160. When the switch is overloaded, the contact reed 170 will be deformed by being heated. Accordingly, the electrical engagement of the contact reed 170 with said platinum conductive protrusion 31 is discontinued. Consequently, the supplied power is interrupted to ensure the safety and property of user.

Even the disclosure of '748 provides an improved breaking switch to solve the problem encountered by a see-saw switch, its defects can still be concluded as follows:

1. When the button 13 is depressed or jammed, or the curved spring blade 24 experiences a fatigue, the conductive protrusion 170 will not be disconnected even in case of an overload. The breaking switch itself will be melted by the increasing heat. The potential risk of getting fire can not be suitably avoided.
2. The operating principle of the breaking switch is based as follows. When the contact reed 170 made of double alloy piece is heated during an overload and the temperature rises till the breaking temperature (normally set between 100–150 degrees Celsius), the resilience will be larger than the curved spring blade 18 such that the breaking switch is actuated to opened circuit. In this case, even if the button 21 is depressed to ON position and if the resilience of the contact reed 170 is still larger than the of curved spring blade 18, the engagement of the conductive protrusion 171 will be disconnected as soon as it is contacted. If the button 13 is kept at depressed position; even an engagement is attained between the conductive protrusions 171, 160, the contact reed 170 doesn't work and the temperature is still increasing. On the other hand, the platinum conductive protrusions 171, 160 are contacted with each other by means of the depressing force of the user. If the force exerted thereon is not well distributed, a spark will be caused in contacting owing to load and poor contact. In this case, the platinum conductive protrusions 171, 160 will be easily oxidized and the service life will then be shortened.
3. The contact reed 170 has a planar configuration which can only be moved and deformed in one direction when experiencing an increasing heat. Accordingly, the curved spring blade 18 shall be incorporated to achieve a two-directional breaking function. The curved spring blade 18 is made from metal sheet by punching. It's difficult to make the resilient rating of each curved spring blade 18 identical. If the rating is too high, the contact reed 170 can not be disconnected during the overload condition and the potential risk of getting fire will happen. If the rating is too low, the engagement between two adjacent platinum conductive protrusions is insufficient such that a spark will be caused. This spark will reduce the service life of the platinum conductive protrusions 171, 160.

Taiwan Pat. 334165, as shown in FIGS. 3A and 3B, discloses a change-over device of a safety switch for protecting it from the overload which is intended to remove the defects of the conventional switch. The safety switch includes a change-over button 20 having an insulting drive element 21 and an attachment element 22 at one end thereof. One end of a conductive strip 23 is clamped at one side of the attachment element 22. The insulting drive element 21 is connected with a spring 24 at one end thereof. When the switch is overloaded, the conductive strip 23 will be deformed for disconnection from the contact point so that the conductive, strip 23 together with the insulating drive element 21 are positioned by means of the insulating drive element 21 into an arched groove 25 for breaking the current loop. However, this kind of safety switch also includes the defects of the U.S. Pat. No. 5,262,748. If one of the change-over button 20, the insulating drive element 21 or the attachment element 22 is malfunction, the conductive strip 23 doesn't work even in an overloaded situation. Besides, the spring 24 is wound by a metal wire so that it's difficult to provide the resilience of each section thereof to be identical. The defect of too strong or too weak resilience is also present. Thus, it's still not an excellent safety switch.

Previously, the inventor of the present invention tried to remove the above-mentioned defects with U.S. Pat. No. 5,760,672. It is characterized by means of a slight and proper jumping space ($\Delta S$) being created between a pushing part and a pulling part of a push-pull rod 9 (similar to the above-mentioned attachment element 22). Accordingly, when a button shade or the push-pull rod 9 is defective, an alloy plate 7 (similar to the above-mentioned conductive strip 23 or the contact reed 170) will also be deformed in a half-escape manner to be separated from the contact point 71. Therefore, the switch is situated in a disconnected state for an electrical safety. The expected effect thereof can be achieved under an ordinary conditions. However, the half-disconnection design is still not a complete structure. Since the jumping space (ΔS) is not perfect in setting and installing aspect, the half-escape function wouldn't work even in case of a slight carelessness.

In the above-mentioned safety switches, the attachment element (or push-pull rod) and the conductive strip (contact reed or alloy plate) are connected in a coupled state. Therefore, if one of the attachment element or the change-over button is defective, the conductive strip can't be deformed for disconnection.

SUMMARY OF THE INVENTION

It is a primary object of the present invention to remove the above-mentioned disadvantage of the conventional safety switch and to provide a safety switch having a change-over push-pull rod between a button shade and a conductive strip. The top end of the push-pull rod is pivotally connected to the button shade while the bottom end thereof includes a pushing part and a pulling part which are not the same length. The push-pull rod and the external end of the conductive strip are not coupled, but situated in a pushing and pulling change-over relationship. In cooperation with the inner and outer spring elements and a play groove, the conductive strip will be collapsed in a manner of reverse deformation for a disconnection when the switch is overloaded, without being restricted by the pushing part and the pulling part. Besides, the safety switch includes the ON-OFF change-over function under ordinary state. The configuration is therefore simplified and the user safety is much more ensured.

It is another object of the present invention to provide a safety switch for protecting circuit which has the same effect as the conventional fuseless switch with mechanical disconnection in spite of simplification of its structure.

BRIEF DESCRIPTION OF THE DRAWINGS

The accomplishment of this and other objects of the invention will become apparent from the following description and its accompanying drawings of which:

FIG. 8A is an enlarged view of the circled part shown in FIG. 8; and

DETAILED DESCRIPTION OF THE PREFERRED EMBODIMENT

Figure 1:
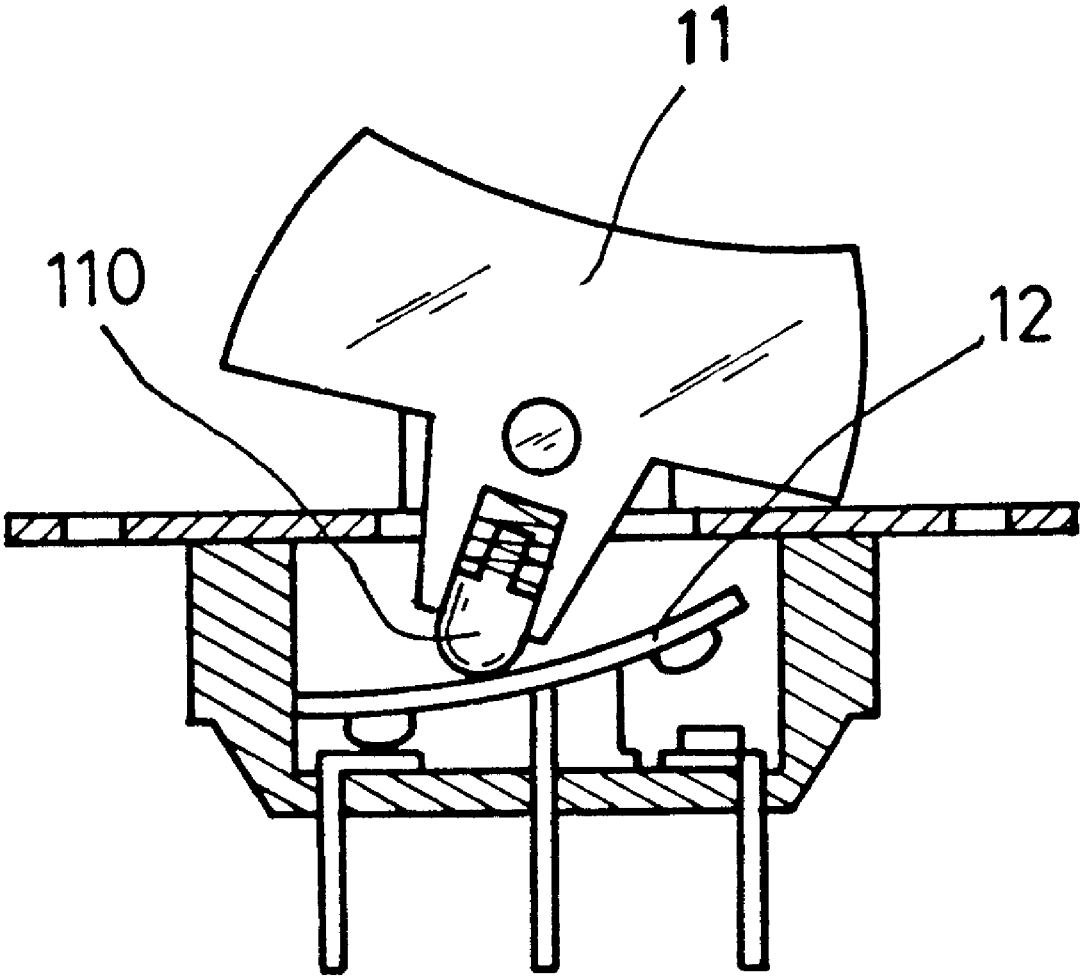
PRIOR ART FIG. 1
FIG. 1 is a schematic drawing showing the configuration of a conventional seesaw switch.
Figure 2:
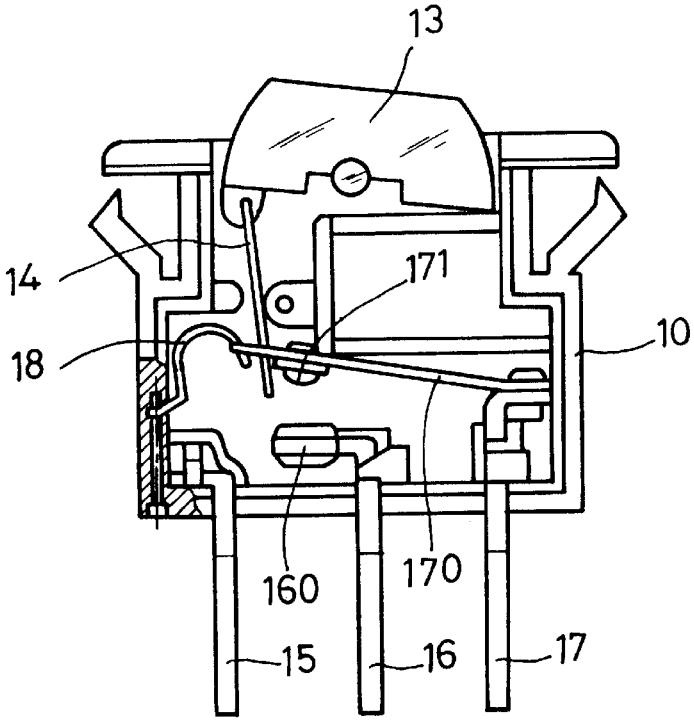
FIG. 2 (A) PRIOR ART
FIGS. 2A and 2B disclose the breaking switch of U.S. Pat. No. 5,262,748.
Figure 2:
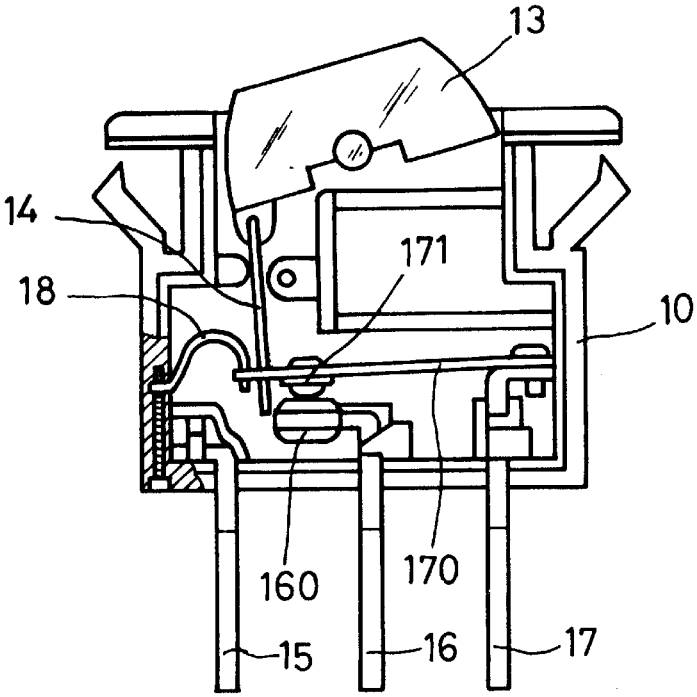
FIG. 2 (B) PRIOR ART
Figure 3A:
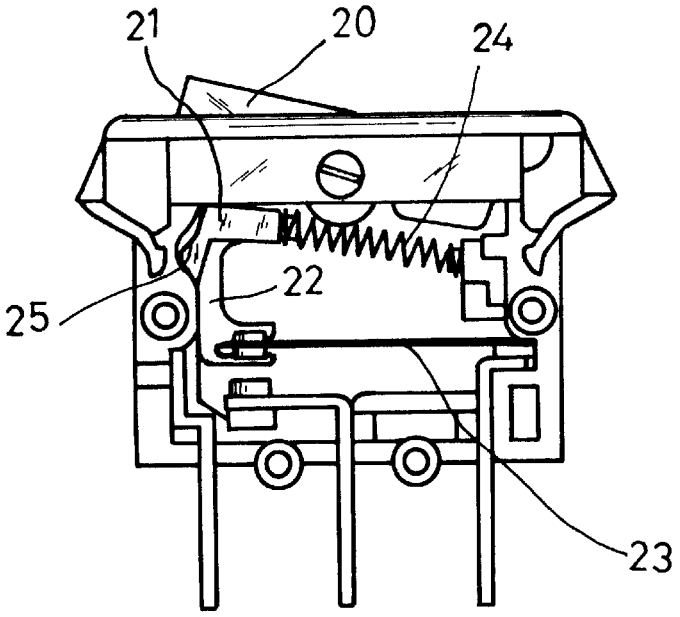
FIG. 3(A) PRIOR ART
FIGS. 3A and 3B disclose the switch of Taiwan Pat. 334156.
Figure 3B:
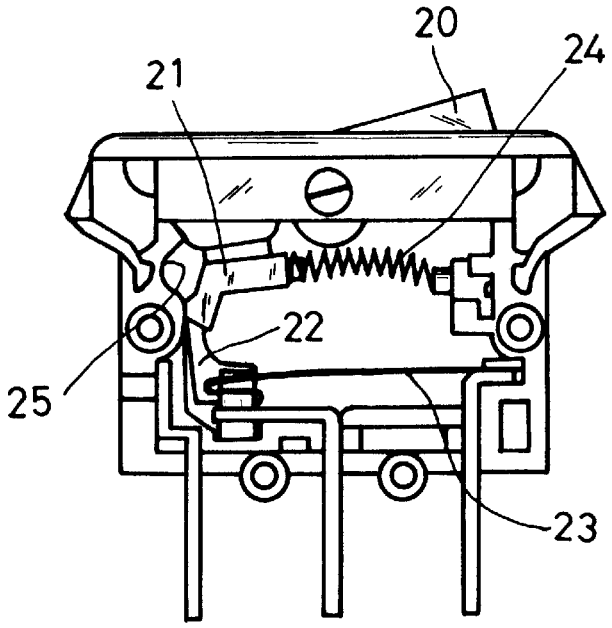
FIG. 3(B) PRIOR ART
Figure 4:
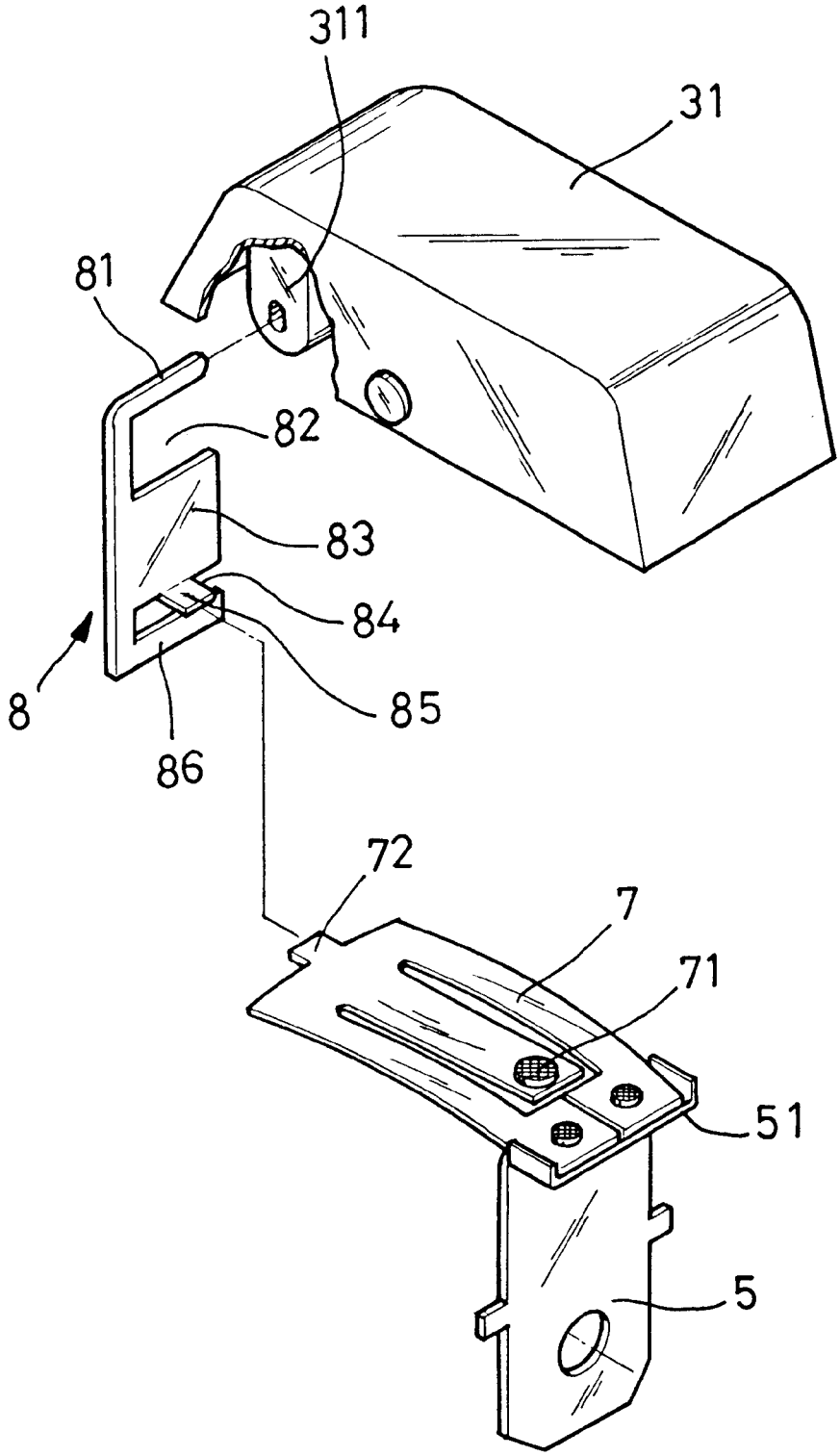
FIG. 4 is an exploded perspective view of an applicable embodiment of the safety switch of the present invention.
Figure 5:
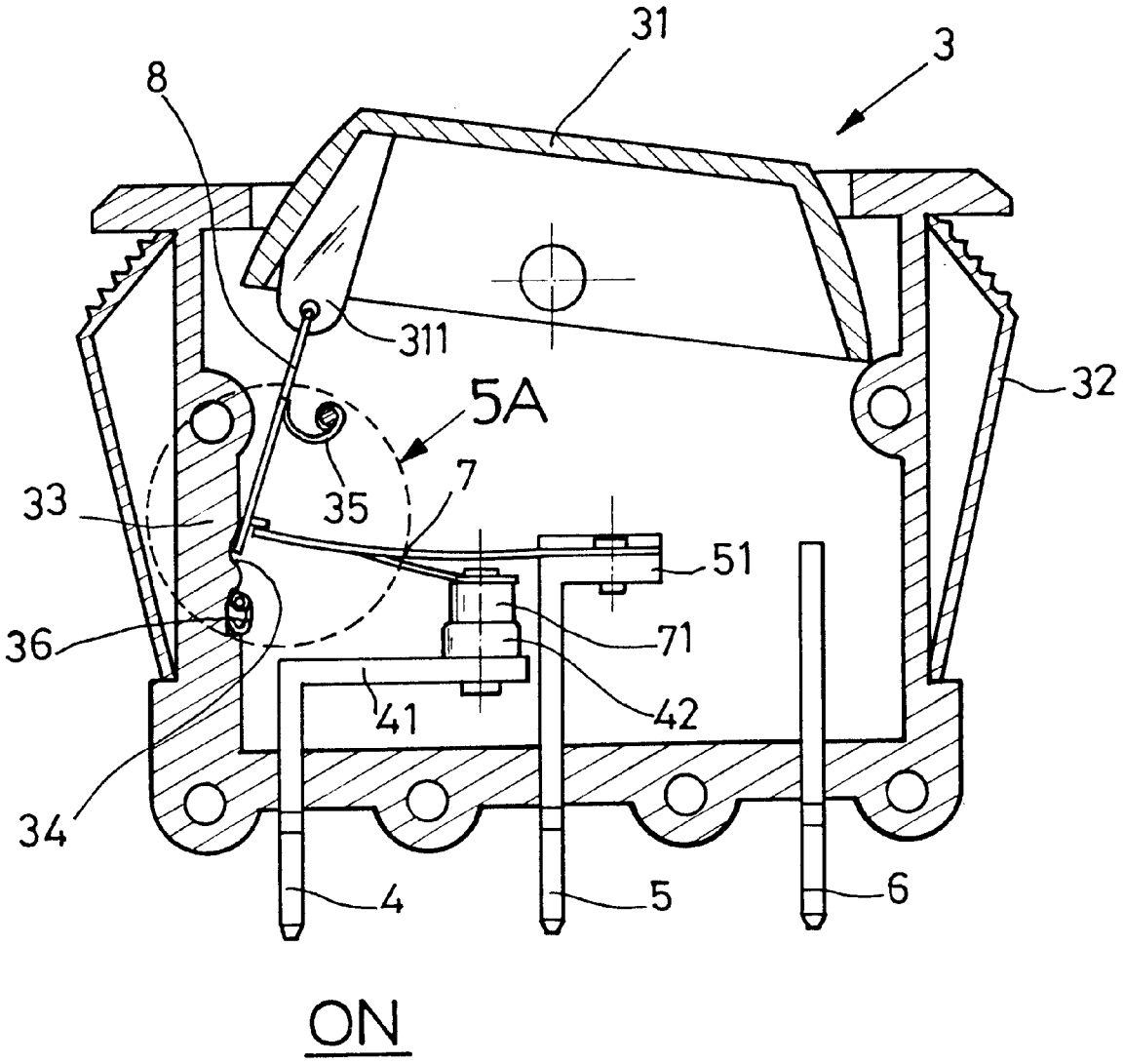
FIG. 5 is a sectional view of the applicable embodiment of the safety switch of the present invention showing a connected ON-state.
Figure 5:
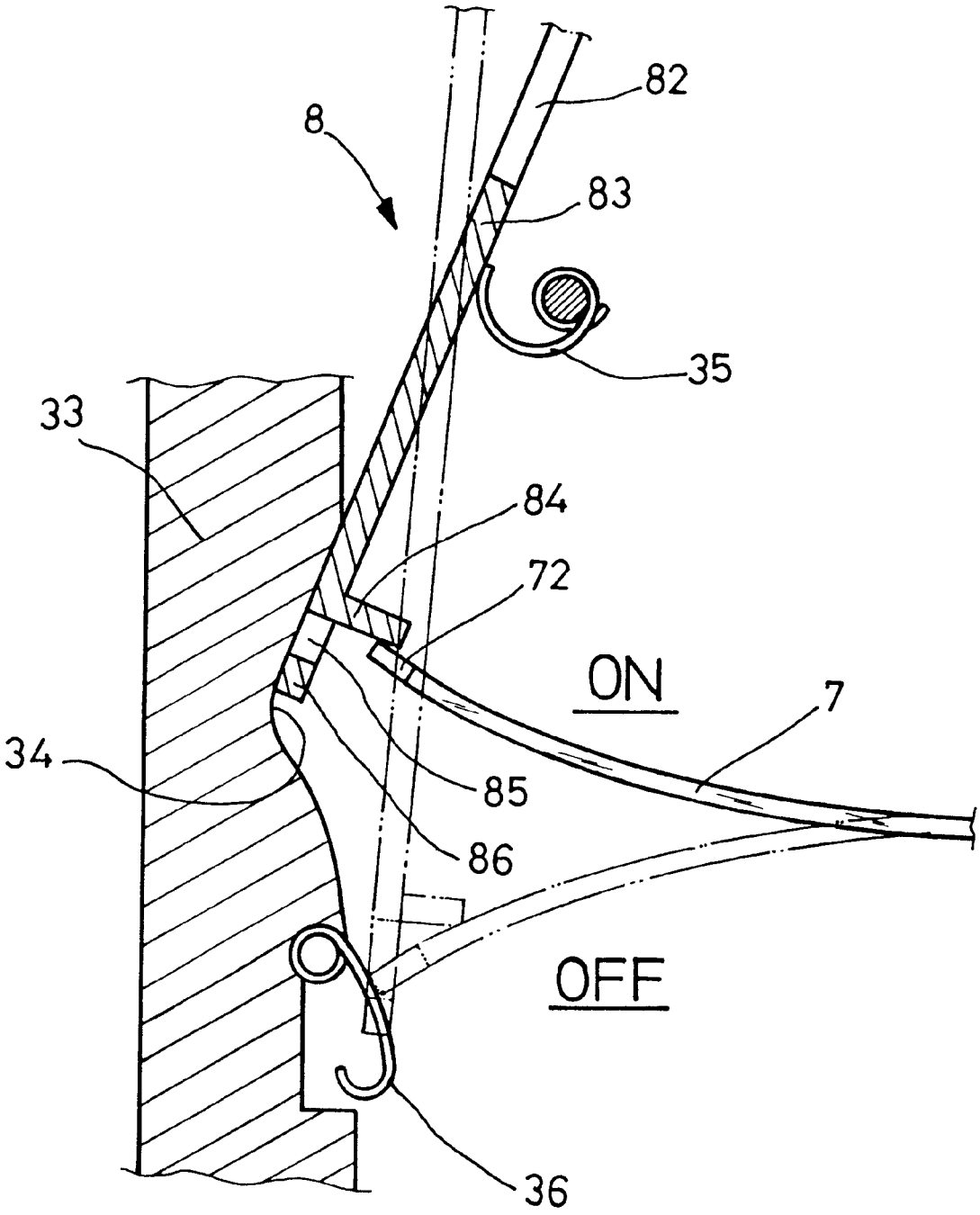
Figure 6:
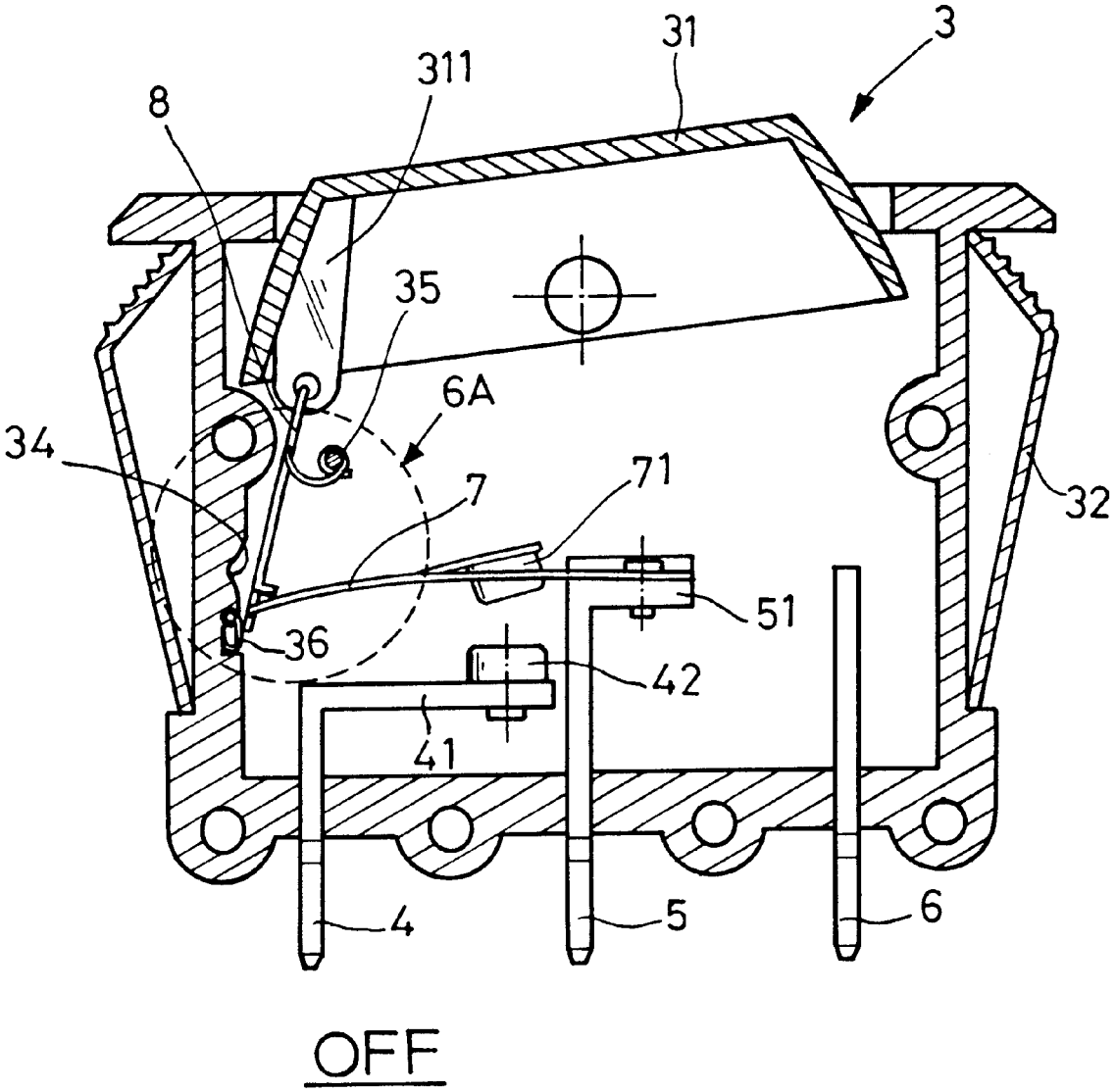
FIG. 6 is a sectional view of the applicable embodiment of the safety switch of the present invention showing a disconnected OFF-state.

First of all, referring to FIG. 4 together with FIGS. 5 and 6, a first embodiment of the safety switch in accordance with the present invention primarily includes:

a rectangular housing 3 having a button shade 31 pivotally disposed at top of the housing 3 and having a left and right resilient hookers 32;

three pairs of conductive plates 4, 5 and 6, the top of the first conductive plate 4 being provided with a first bending portion 41. having a first platinum conductive boss 42, the top of the second conductive plate 5 being provided with a second bending portion 51, the top of the second bending portion 51 being connected with a conductive piece 7 made of alloy plate, a second platinum conductive boss 71 being fixed at the bottom of the conductive piece 7 corresponding to the first platinum conductive boss 42 of the first conductive plate 4;

a push-pull rod 8 having a shaft-shaped cross piece 81 at the top thereof, the shaft-shaped cross piece 81 being insertable into a projecting ear 311 at the inner rim of the button shade 31 in a pivotal connection state, a free end of the conductive piece 7 being movable by the lower end the push-pull rod 8;

wherein the improvement is characterized by:

the front end of the conductive piece 7 being fitted with a projecting piece 72, a groove 82 being formed under the shaft-shaped cross piece 81 of the push-pull rod 8, a rectangular piece 83 for supporting being formed under the groove 82, a clamping slot 85 being formed under the rectangular piece 83, a pushing part 84 being disposed above the clamping slot 85 and corresponding to the projecting piece 72 of the conductive piece 7, a pulling part 86 being disposed at the bottom rim of the clamping slot 85; and a play groove 34 being disposed at a certain position of a side wall 33 of the rectangular housing 3, a first spring element 35 being provided at the upper start position (ON-state) of the push-pull rod 8 and pushing against the rectangular piece 83 from the inner side to the outer side, a second spring element 36 being provided at the lower start position (OFF-state) of the push-pull rod 8 and pushing against the pulling part 86 from the outer side to the inner side.

In accordance with the above-mentioned technique and features, when the conductive piece 7 inside of the rectangular housing 3 is in a connection ON-state, the front end thereof will rise, as shown in FIG. 5A. At that time, the first spring element 35 slightly pushes against the rectangular piece 83 so that the bottom end of the push-pull rod 8 leans outwards inside of the play groove 34. By means of this angle difference, the projecting piece 72 of the conductive piece 7 is separated from the clamping slot 85 and still located under the pushing part 84. Accordingly, if the push-pull rod 8 moves downwards, the conductive piece 7 is also able to be pushed by the pushing part 84 for deformation and reversibly disengaged into a disconnection OFF-state. When the temperature of the conductive piece 7 rise to be deformed due to power overload, a deformed disengagement in a collapsing manner can be achieved because the outer end of the conductive piece 7 is not connected to the push-pull rod 8. Consequently, the power is disconnected immediately to ensure the electrical safety.

Figure 6A:
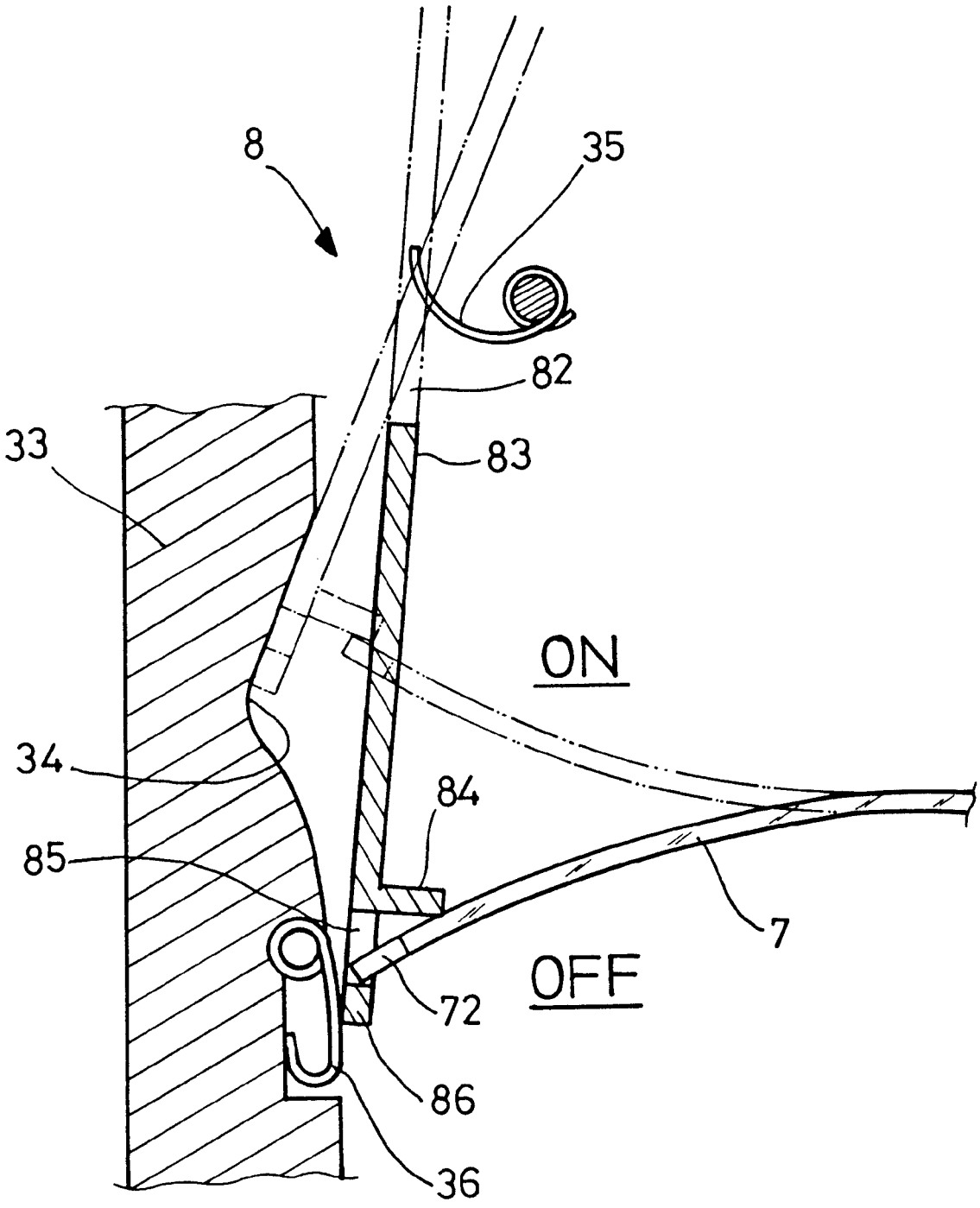
FIG. 6A is an enlarged view of the circled part shown in FIG. 6.
Figure 7:
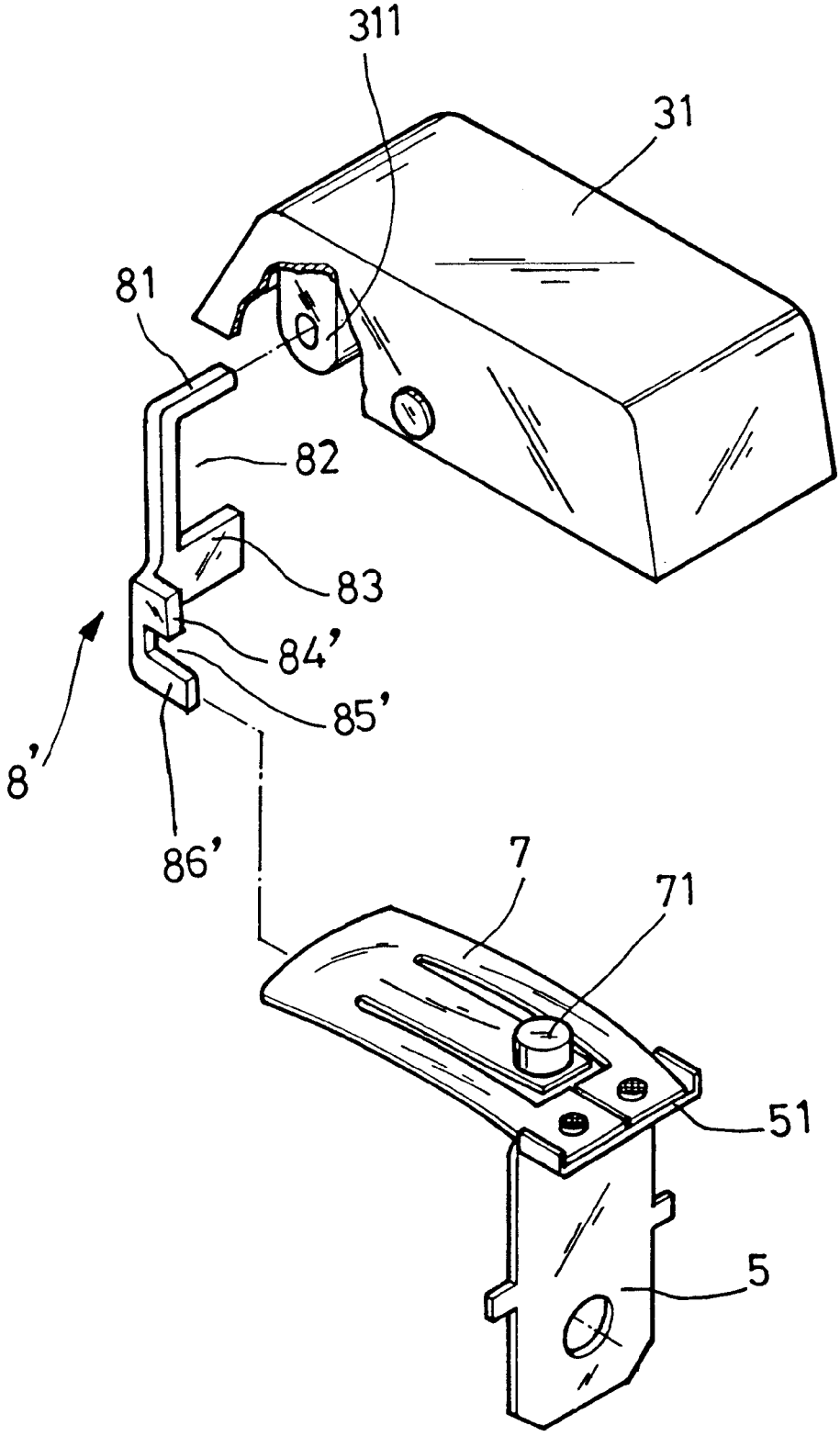
FIG. 7 is an exploded perspective view of another applicable embodiment of the safety switch of the present invention.
Figure 8:
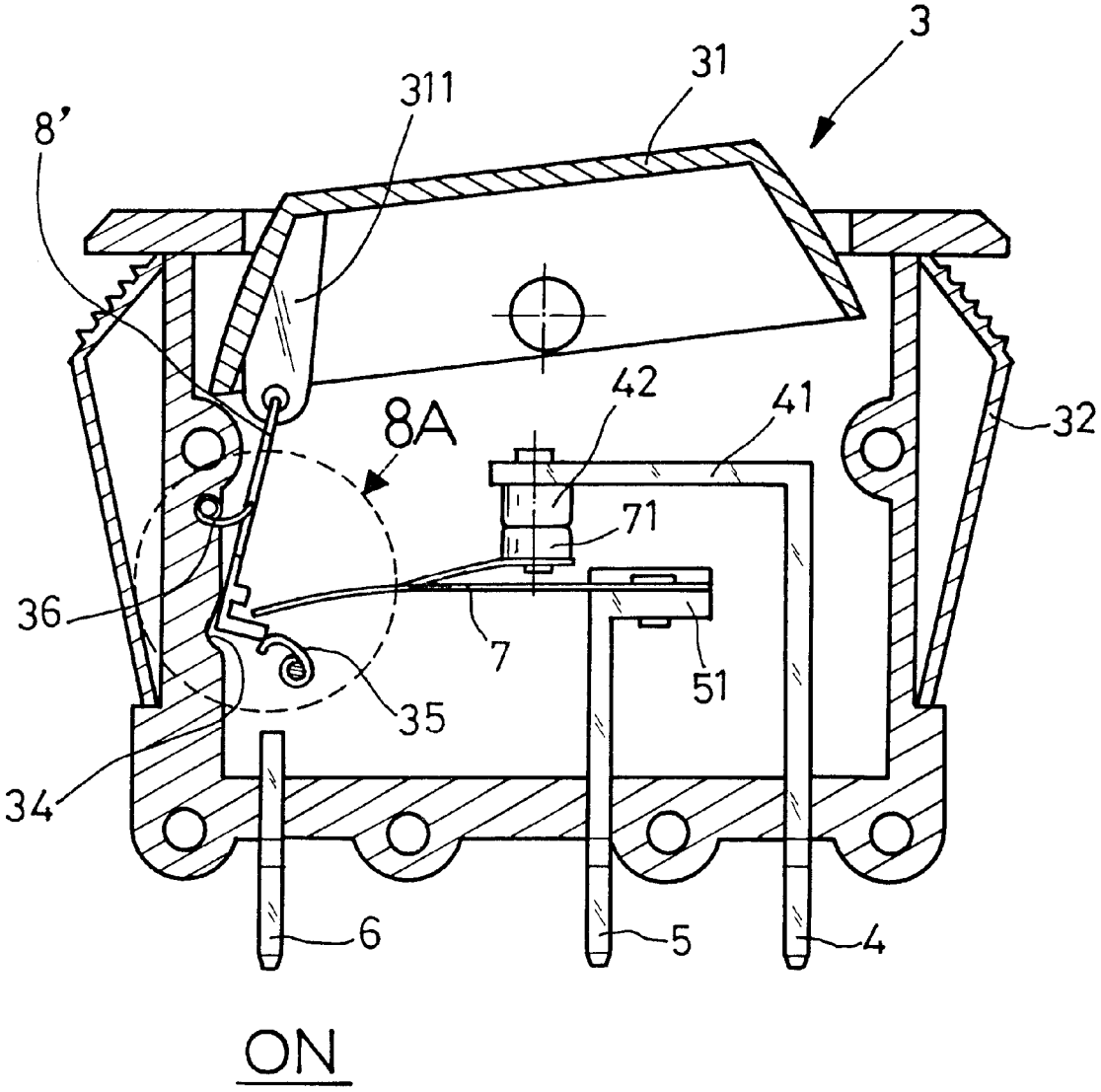
FIG. 8 is a sectional view of another applicable embodiment of the safety switch of the present invention showing a connected ON-state.
Figure 8:
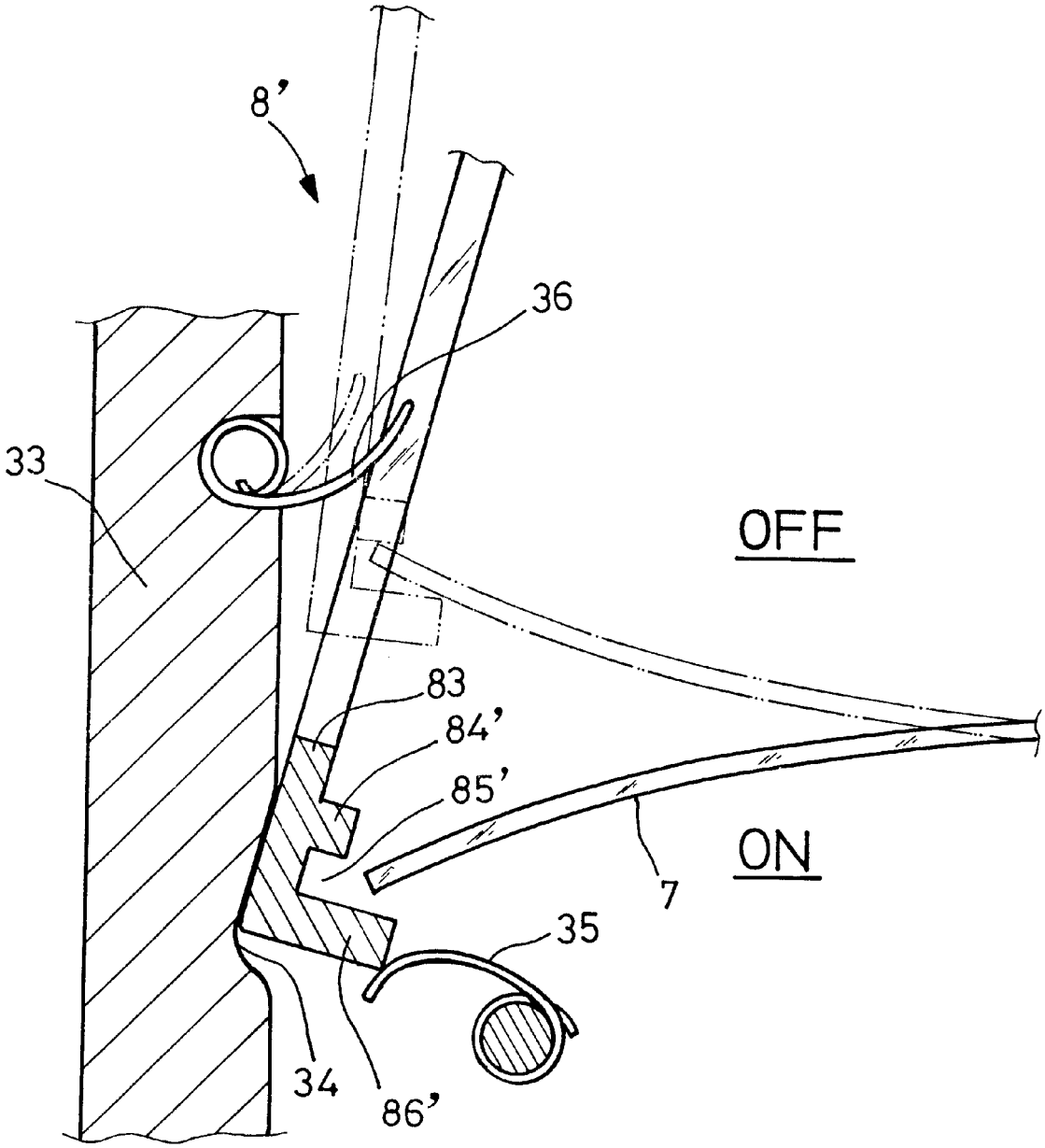
Figure 9:
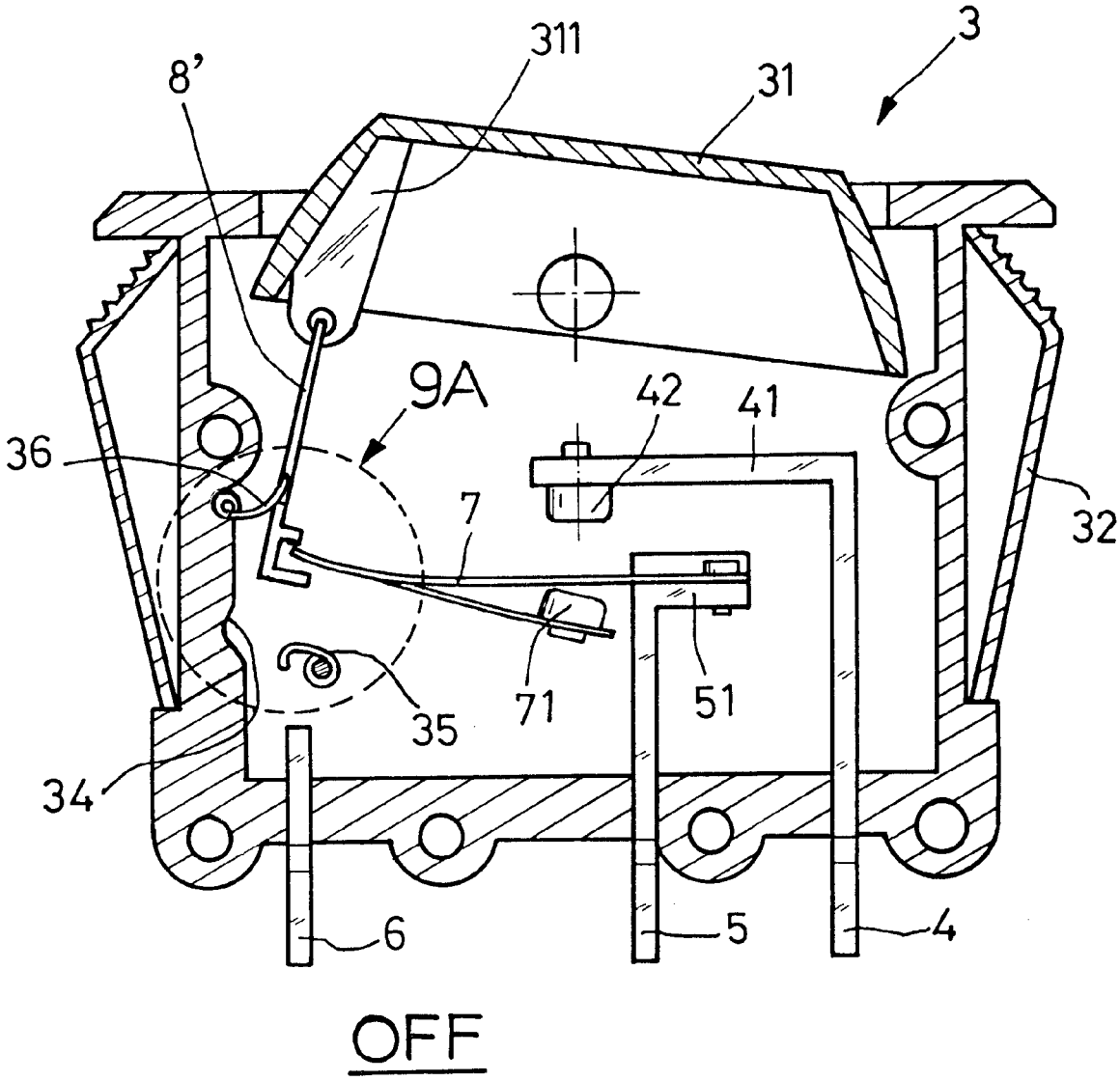
FIG. 9 is a sectional view of another applicable embodiment of the safety switch of the present invention showing a disconnected OFF-state.

Furthermore, after the conductive piece 7 is disengaged after the collapsing deformation, the bottom end of the push-pull rod 8 is separated from the play groove 34 and shifted downwards by means that the button shade 31 is depressed rightwards. Moreover, the push-pull rod 8 pushes against the second spring element 36. Meanwhile, the rectangular piece 83 of the push-pull rod 8 is separated from the first spring element 35 so that the first spring element 35 is located in the groove 82, as shown in FIG. 6 and 6A. At this time, the first spring element 35 doesn't push against the rectangular piece 83 while the second spring element 36 pushes against the pulling part 86 from the outer side to the inner side. Accordingly, the projecting piece 72 of the conductive piece 7 is engaged into the clamping slot 85 to create a coupled relationship with the push-pull rod 8. That is, when the push-pull rod 8 is pulled upwards, the conductive piece 7 can be deformed to spring into a connected ON-state by means that the pulling part 86 at the bottom of the push-pull rod 8 exerts force upon the conductive piece 7. When the push-pull rod 8 is shifted upwards, the first spring element 35 will contact with the rectangular piece 83. Therefore, as shown in FIG. 5A, the push-pull rod 8 will be pushed outwards to enable the push-pull rod 8 to be sloped with the shaft-shaped cross piece 81 as shaft center. Accordingly, the projecting piece 72 of the conductive piece 7 will be separated from the clamping slot 85 again and rapidly reversibly disengaged by means of deformation in a collapsing state in case of overload.In addition, with respect to the external end of the conductive piece 7' being deformed upwards in a disconnected OFF-state, as shown in FIGS. 7 through 9, the primary configuration is the same to that of the former embodiment. The difference lies in the length and direction of the push-pull body of the push-pull rod 8', the position of the first and second spring elements and the play groove. The same features won't be described hereinafter. The main structure is characterized by:

the push-pull rod 8' having a groove 82 disposed under the shaft-shaped cross piece 81 thereof, a rectangular piece 83 used for supporting being formed at bottom rim of the groove 82, a pushing short part 84' and a pulling long part 86' vertically extending at one side of the rectangular piece 83, a clamping slot 85' being disposed at the connection end of the both; and a play groove 34 being disposed at a certain position of a side wall 33 of the rectangular housing 3, a first spring element 35 being provided at the lower start position (ON-state) of the push-pull rod 8' and pushing against the pulling long part 86' from the inner side to the outer side, a second spring element 36 being provided at the upper start position (OFF-state) of the push-pull rod 8 and pushing against the pulling part 86 from the outer side to the inner side.

In accordance with the above-mentioned technique and features, it's apparent that this has the same effect and functions as the previous embodiment. The difference of this embodiment from the previous embodiment lies in that the conductive piece 7 of this embodiment has no projecting piece 72 while the pulling long part 86' and the pushing short part 84' is vertically disposed to the conductive piece 7. It's beneficial to the second platinum conductive boss 71 disposed at the external end of the conductive piece 7 for controlling the change-over action of the conductive piece 7 by means of the pulling long part 86' and the pushing short part 84' at one side thereof to meet the requirement of the industry.

The collapsing construction of this embodiment is the same as the previous embodiment in the actuation way except the opposite direction. As shown in FIGS. 8 and 8A, when the conductive piece 7 inside of the rectangular housing 3 is in a connection ON-state, the front end thereof will be deformed downwards. At that time, the first spring element 35 slightly pushes against the pulling long part 86' so that the bottom end of the push-pull rod 8' leans outwards inside of the play groove 34. By means of this angle difference, the external end of the conductive piece 7 is separated from the clamping slot 85' and still located above the pulling long part 86'. Accordingly, if the push-pull rod 8' moves downwards, the conductive piece 7 is also able to be pushed by the pulling long part 86' for deformation and reversibly disengaged into a disconnection OFF-state. When the temperature of the conductive piece 7 rises and said piece is about to be deformed due to the overload, a deformed disengagement in a collapsing manner can be achieved because the outer end of the conductive piece 7 is not restricted by the pushing short part 84'. Consequently, the power is disconnected immediately to ensure the electrical safety.

Figure 9A:
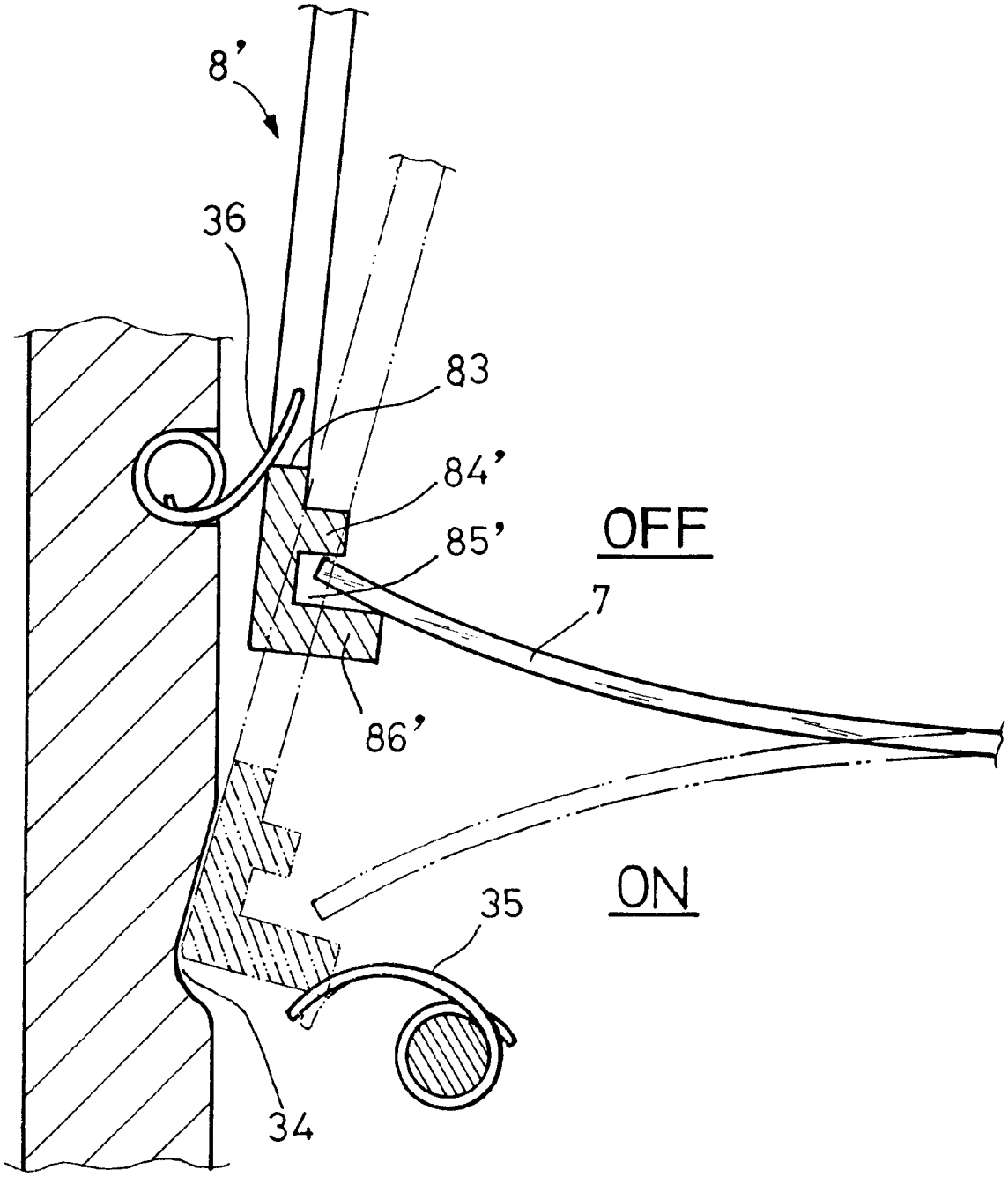

Furthermore, as shown in FIGS. 9 and 9A, after the conductive piece 7 is disengaged after the collapsing deformation, the bottom end of the push-pull rod 8' is separated from the play groove 34 and shifted upwards by means that the button shade 31 is depressed rightwards. In addition, the rising rectangular piece 83 of the push-pull rod 8' pushes against the second spring element 36. Therefore, the second spring element 36 slightly pushed from the outside to the inside against the push-pull rod 8' and the external end of the conductive piece 7 is engaged into the clamping slot 85' to create a coupled relationship with the push-pull rod 8'. That is, when the push-pull rod 8' is pushed downwards, the conductive piece 7 can be deformed to spring into a connected ON-state by means that the pushing short part 84' exerts force upon the conductive piece 7. When the push-pull rod 8' is shifted downwards, the second spring element 36 will be separated from the rectangular piece 83 while the first spring element 35 will contact with the pulling long part 86', as shown by the dotted line or FIG. 8A. Therefore, the bottom end of the push-pull rod 8' will be pushed outwards to enable the push-pull rod 8' to be sloped with the shaft-shaped cross piece 81 as shaft center. Accordingly, the external end of the conductive piece 7 will be separated from the clamping slot 85' again and rapidly reversibly disengaged by means of deformation in a collapsing state in case of power overload.

Accordingly, in accordance with the above-mentioned two embodiments, the conductive strip will be collapsed in a manner of reverse deformation for a disconnection when the switch is overloaded, without being restricted by the pushing part and the pulling part of the push-pull rod. Besides, the safety switch includes the ON-OFF change-over function under ordinary state as the conventional fuseless switch with mechanic disconnection. The configuration of the present invention is therefore simplified and the user safety is much more ensured.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A safety switch for protecting circuit comprising:

a rectangular housing having a button shade pivotally disposed at top of the housing and having a left and right resilient hookers;

three pairs of conductive plates, the top of said first conductive plate being provided with a first bending portion having a first platinum conductive boss, the top of said second conductive plate being provided with a second bending portion, the top of said second bending portion being connected with a conductive piece made of alloy plate, a second platinum conductive boss being fixed at the bottom of said conductive piece corresponding to said first platinum conductive boss of said first conductive plate;

a push-pull rod having a shaft-shaped cross piece at the top thereof, said shaft-shaped cross piece being insertable into a projecting ear at an inner rim of said button shade in a pivotal connection state, a free end of said conductive piece being movable by a lower end said push-pull rod;

wherein the improvement is characterized by:

the front end of said conductive piece being fitted with a projecting piece, a groove being formed under said shaft-shaped cross piece of said push-pull rod, a rectangular piece for supporting being formed under said groove, a clamping slot being formed under said rectangular piece, a pushing part being disposed above the clamping slot and corresponding to said projecting piece of said conductive piece, a pulling part being disposed at a bottom rim of said clamping slot; and a play groove being disposed at a certain position of a side wall of said rectangular housing, a first spring element being provided at an upper start position (ON-state) of said push-pull rod and pushing against said rectangular piece from an inner side to an outer side, a second spring element being provided at a lower start position (OFF-state) of said push-pull rod 8 and pushing against said pulling part from the outer side to the inner side.

2. A safety switch for protecting circuit comprising:

a rectangular housing having a button shade pivotally disposed at top of the housing and having a left and right resilient hookers;

three pairs of conductive plates, the top of said first conductive plate being provided with a first bending portion having a first platinum conductive boss, the top of said second conductive plate being provided with a second bending portion, the top of said second bending portion being connected with a conductive piece made of alloy plate, a second platinum conductive boss being fixed at the bottom of said conductive piece corresponding to said first platinum conductive boss of said first conductive plate;

a push-pull rod having a shaft-shaped cross piece at the top thereof, said shaft-shaped cross piece being insertable into a projecting ear at an inner rim of said button shade in a pivotal connection state, a free end of said conductive piece being movable by a lower end said push-pull rod;

wherein the improvement is characterized by:

said push-pull rod having a groove disposed under said shaft-shaped cross piece thereof, a rectangular piece used for supporting being formed at a bottom rim of said groove, a pushing short part and a pulling long part are vertically extending at one side of said rectangular piece, a clamping slot being disposed at a connection end of the both; and a play groove being disposed at a certain position of a side wall of said rectangular housing, a first spring element being provided at a lower start position (ON-state) of said push-pull rod and pushing against said pulling long part from an inner side to an outer side, a second spring element being provided at an upper start position (OFF-state) of said push-pull rod and pushing against said pulling part from the outer side to the inner side.

* * * * *